United States Patent [19]

Tomma

[11] Patent Number: 4,651,942

[45] Date of Patent: Mar. 24, 1987

[54] WINDER

[75] Inventor: Kauko Tomma, Helsinki, Finland

[73] Assignee: Oy Wärtsilä Ab, Helsinki, Finland

[21] Appl. No.: 746,992

[22] Filed: Jun. 19, 1985

[30] Foreign Application Priority Data

Jul. 10, 1984 [FI] Finland ..... 842752

[51] Int. Cl.[4] ..... B65H 18/16; B65H 19/30

[52] U.S. Cl. ..... 242/65; 242/56 R

[58] Field of Search ..... 242/56 R, 56.2, 56.4, 242/65, 66, 67.1 R, 56.5

[56] References Cited

U.S. PATENT DOCUMENTS 3,586,253 6/1971 Gilbank et al. ..... 242/65

4,458,853 7/1984 Heymanns ..... 242/56.4

*Primary Examiner*—John M. Jillions

*Attorney, Agent, or Firm*—Dellett, Smith-Hill and Bedell

[57] ABSTRACT

An arrangement for the forming of a roll by winding a web in the longitudinal direction thereof around a core or the like, which arrangement comprises a supply appliance for a new core and devices for the support of the roll by a peripheral support and/or a central support and in which arrangement the supply of said new core is carried out after the removal of the complete roll, the removal of said complete roll being carried out from the winding position on the floor level over the new core, which is located in the supply appliance, said supply appliance comprising supply units and being adapted in connection with a movable support appliance, said new core being supplied in to the winding position to retain a leading end of the web against a support drum exerting the peripheral support, said support appliance comprising a movable support member exerting a holding grip on the core in the winding position or in the immediate vicinity thereof.

29 Claims, 4 Drawing Figures

WINDER

The invention relates to an arrangement for forming a roll by winding a web in its longitudinal direction around a core, which arrangement comprises a supply appliance for a new core and devices for the roll support by means of peripheral and/or central support forces and in which arrangement the new core is supplied after the complete roll is removed from the winding position.

PRIOR ART

It is important in automated winders for paper rolls that the measures preceding a new winding are possible to carry out already during the foregoing winding process. It is of special importance to arrange the new core at an arbitrarily chosen time event in to the core supplier, by means of which the new core is moved in to the winding position after the previous roll is removed. Known arrangements give rise to the problem that the core supplier, which starts the core supply from outside the actual winder, requires its own space. If the removal track of the roll intersects the track of the core placement on the other hand, a core cannot be placed in the core supplier until after the roll has been removed, if the supplier is located in connection with the actual winder. Another problem existing especially in centrally supported windings is that the synchronizing of the roll removal and the core supply is difficult to carry out. As a result of these known defects, the capacity of the winder arrangement cannot be optimally exploited.

THE OBJECT OF THE INVENTION

The object of the invention is to provide a web winder arrangement, in which the winding capacity is effectively utilized by the synchronization of the core supply with the removal of the previous roll. One hereby attempts to provide a one-operator or a fully-automated arrangement by means of automated operation stages. A further object is to provide an arrangement, in which the new core can be placed in the core supplier at a freely chosen time moment during the performance of the previous winding. Hereby the new core will not stand in the way of the removal track of the previous, complete roll. At the same time one attempts to provide an arrangement, in which the core supplier is in connection with the actual winder so that the space required by the supplier is most limited. A particular object is to provide an arrangment which is suited for the operation in an arrangement in which the roll support is at least partially carried out by the central support effect.

In such arrangements the web winding is usually controlled by the adjustment of the line load acting on the roll mantle, that is, the force by which the formed roll is pressed against the support roll. The adjustment of the line load in this winder is carried out usually either automatically, as a result of the roll construction entirely, or by applying external force sources affecting the roll line load, if one diverges from the roll normal use. An example of such winders is the construction presented in the published British Patent Application 2 142 909.

SUMMARY OF THE INVENTION

In a preferred embodiment of the invention, the new core is located in the supply appliance without the core standing in the way of the roll transfer. Furthermore, the supply appliance is located in connection with the actual winder and requires the least possible free space. The one-operator automated function is possible because the supplied core retains the web front end in place. A central support grip on the core can be provided either already when the core retains the new web end in place, or immediately preceding this function. Thus, the supporting grip is in the latter case a function of the final stage for the core supply. The crux of the invention is in that the arranging of the core supply is located at the side of the winder within an area, which already has to be exploited for roll removal in the winding process. A favourable embodiment of the invention includes a core stem movable in the axial direction of the core, which stem is arranged in the central support appliance and by means of which the supporting grip on the core is carried out. One stem known per se comprises a mandrel portion provided with an expansion plug to be placed inside the core. A firm grip between the core transferred in the winding position and the stem is easily carried out by this means. The stem, or both stems located at separate ends of the core, can be provided with motor members, by which the rotation of the web winding can be carried out. If the rotation is carried out by the peripheral support drum, the stem comprises a bearing allowing the rotation.

The core supply appliance is most advisable rotatably supported at a bearing position of the support member, which is located in the central support appliance. This support member, for instance, is a movable, preferably turnable support arm. An arranging corresponding the dimensions of the core, and correspondingly the roll to be formed, is easily available, if the central support appliances located at the first head of the roll are separate from the corresponding members, which are located at the side facing the other head. This arranging can be adapted to correspond the core axial length. The core and the core stem are located co-axially prior to the stem grip on the core. In order to carry out this, the core stem and, supported at its support member, the core supply trough are arranged to cooperate. This supporting grip of the stem on the core being substantiated, the core supply appliance is released from the core.

The descendence track of the completed previous roll is unobstructed, when the supply appliance and the core located therein are lowered below the roll descendence track. The new core is placed in the supply appliance during the winding of the previous roll at a freely chosen time moment. This core is preferably lowered at the level of the hinge point of the support arm in the central support appliance, or in a receiving member located below it. The core lowering can be carried out by the co-operation of the supply appliance and the central support appliance descending the roll.

The core fed during the previous winding in the supply appliance is located at such distance from the winding position, that the previous roll being completed can be transferred over this new core without touching it. In a favourable realization of the core distance, the core placed in the supply appliance is moved in to the winding position along a curved track, the moving centre of which track is located at a member of the central support appliance. The distance of a core track point from this centre is variable. An uncomplicated and effective distance variation is carried out by another support arm movable in its longitudinal direction, which is supported through a bearing at the support arm of the central support appliance.

BRIEF DESCRIPTION OF THE DRAWING

The invention is described in the following with reference to the attached drawing, in which FIG. 1 discloses a side view of a web winder, in which the arrangement according to the invention can be applied, FIG. 2 discloses an embodiment of the invention in a side view and partially in section.

PREFERRED EMBODIMENT OF THE INVENTION

Figure 1:
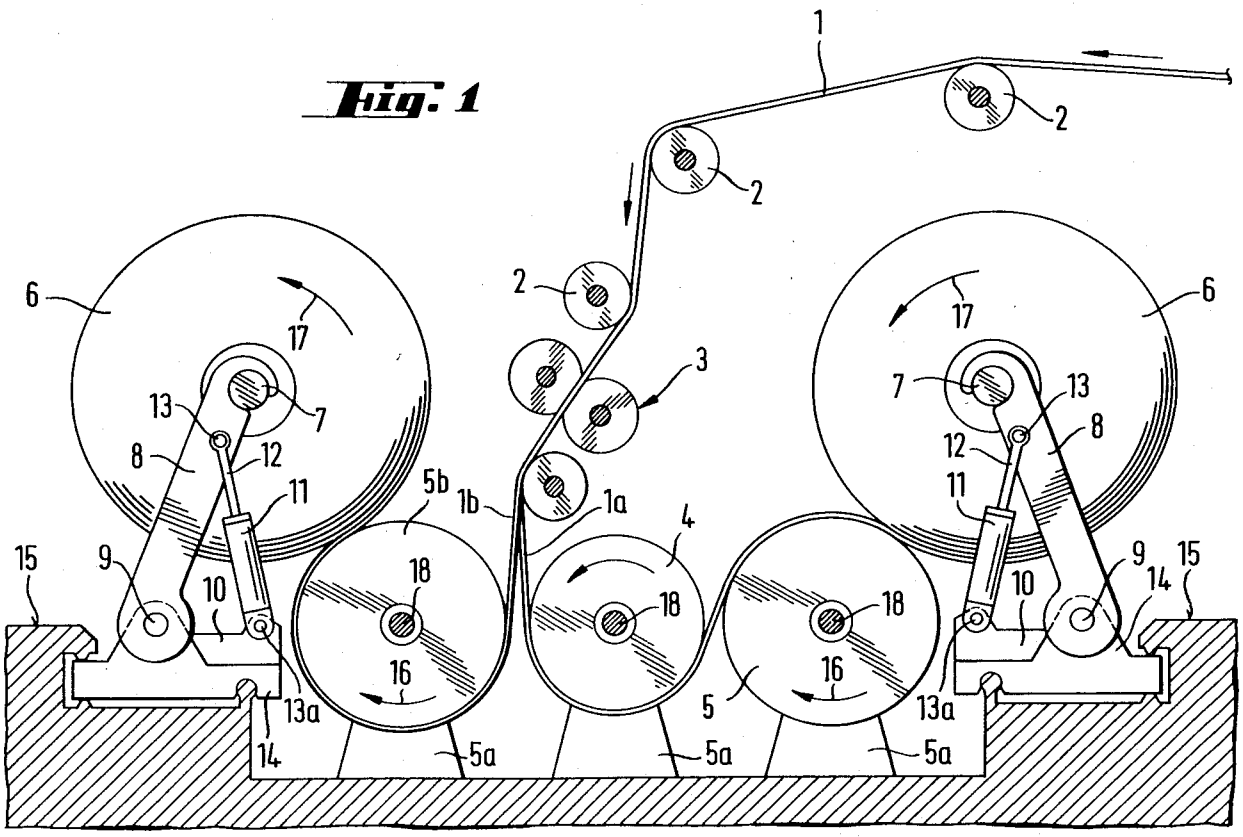

In the drawing, numeral 1 refers to a web to be wound, which is guided over guide rolls 2 to a slitter device 3, in which the rotating slitter blades sever web 1 in several portions, of which two neigbouring portions 1*a* and 1*b* are shown in FIG. 1. Web portion 1*a* runs via an auxiliary drum 4 to a support drum 5 located at right, whereas web portion 1*b* is directly guided to a support drum 5*b* located at left. Support drums 5 and 5*b* rotate in the same direction indicated by an arrow 16. Supported against the support drums, rolls 6 are formed which receive peripheral support by support drums 5, 5*b* and, at the same time, central support by support arms 8. The central shafts of rolls 6 are supported via a stem 7 at arms 8. Each roll 6 is supported by two support arms 8 and, the roll reaching the desired diameter, the roll is lifted to a floor level 15 of the arrangement by turning support arms 8 away from support drum 5 by means of a work cylinder-turning arm 10–12. Support arms 8 rotate thereby around their bearings 9. Work cylinder-turning arm 10–12 is rotatably supported by a bearing 13 at support arm 8. Each support arm 8 is attached at a sledge 14 movable in the roll axial direction. Work cylinder-turning arm 10–12 is a two-staged tilt device known per se, an arm 10 of which is journalled at sledge 14, for instance, in a bearing (not shown) in the vicinity of bearing 9. The distance between the support arms is adjustable by moving the sledges to correspond to the desired roll length. A normal axial length of the roll is usually 1 m, but rolls having an axial length of only 40 cm may be wound, whereas the maximum practical axial length needed for rolls just slightly exceeds 260 cm. The weight of a full-sized roll of this length is about 4 tons. Numeral 5*a* refers to a frame member of rolls 4,5,5*b*.

Support drums 5 and 5*b* and auxiliary drum 4 are journalled at the same level as support arms 8, that is at floor level 15 of the arrangement. The journalling of the drums is not shown in detail, it is only drafted by a member 18.

Figure 2:
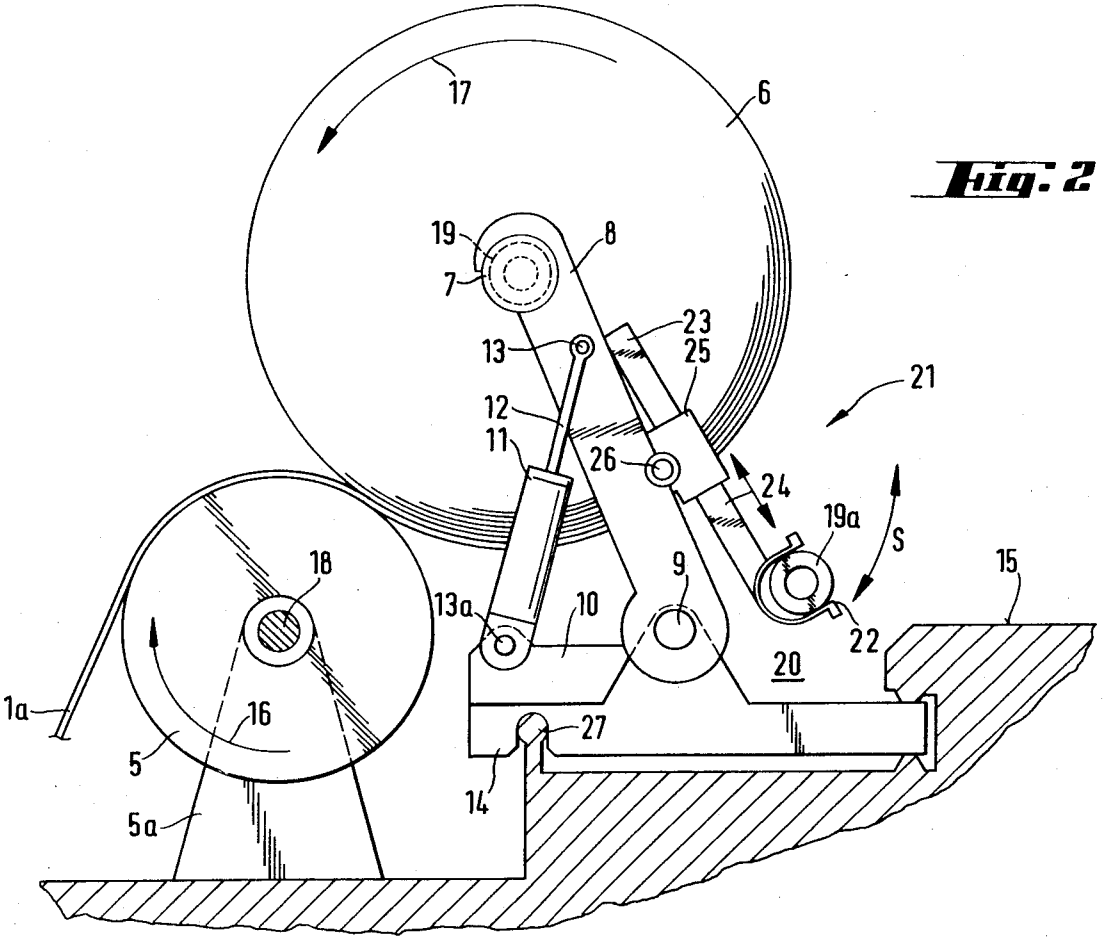

FIG. 2 discloses the final stage of winding a nearly completed roll 6, prior to severing the web or the web strip 1*a*. At the outer end of support arm 8 is located stem 7, which can be moved in a direction corresponding to the axis of roll 6. Stem 7 is rotatable around its axis as known per se. A core 19 is under a firm grip of stem 7 during the winding in order to provide the central support. The turning of support arm 8 around its journalling point 9 is carried out according to the peripheral support-central support geometry, as disclosed in the published British Patent Application 2 142 909. The turning of support arm 8 to a position for descending roll 6, or to a supply position of a new core 19*a* in the direction towards support drum 5, is carried out by means of tilt arm 10 and a work cylinder 11. A hinge 13*a* between cylinder 11 and arm 10, correspondingly a journalled hinge 13 between support arm 8 and power arm 12, make possible the relative motions carried out during the turning.

New core 19*a* is located in a supply appliance 21, which comprises a supply unit 22–26 supported at support arm 8. A first and a second arm 8 is located in the axial direction at a corresponding side of roll 6. One end of core 19*a* is locked by pinch locking in a lock trough 22 of the supply unit; the other end of core 19*a* is located in trough 22 located at the other side of roll 6. A supply arm 23 of the supply unit is movably supported at a bushing 25, bushing 25 being rotatably journalled at arm 8 in a bearing 26. The motion of arm 23 relative to bushing 25 is shown by an arrow 24 and the rotation of the upply unit relative to the bearing 26 by an arrow S. The functions and members 23–26 of two supply units are so arranged, that cores 19 or 19*a* are easily accommodated between members 23, 25–26 of the supply units. Troughs 22 extend towards each other so that troughs 22 exert a firm grip on core 19*a*.

In an uncomplicated application of motion 24, trough 22 can be located at two different distances from bushing 25. In the position corresponding the minimum distance, arm 23 is locked at bushing 25. The movement to a position corresponding to the maximum distance is carried out by releasing the locking, after which arm 23 is pushed in to said position by a spring member (not shown) acting upon arm 23.

Figure 3:
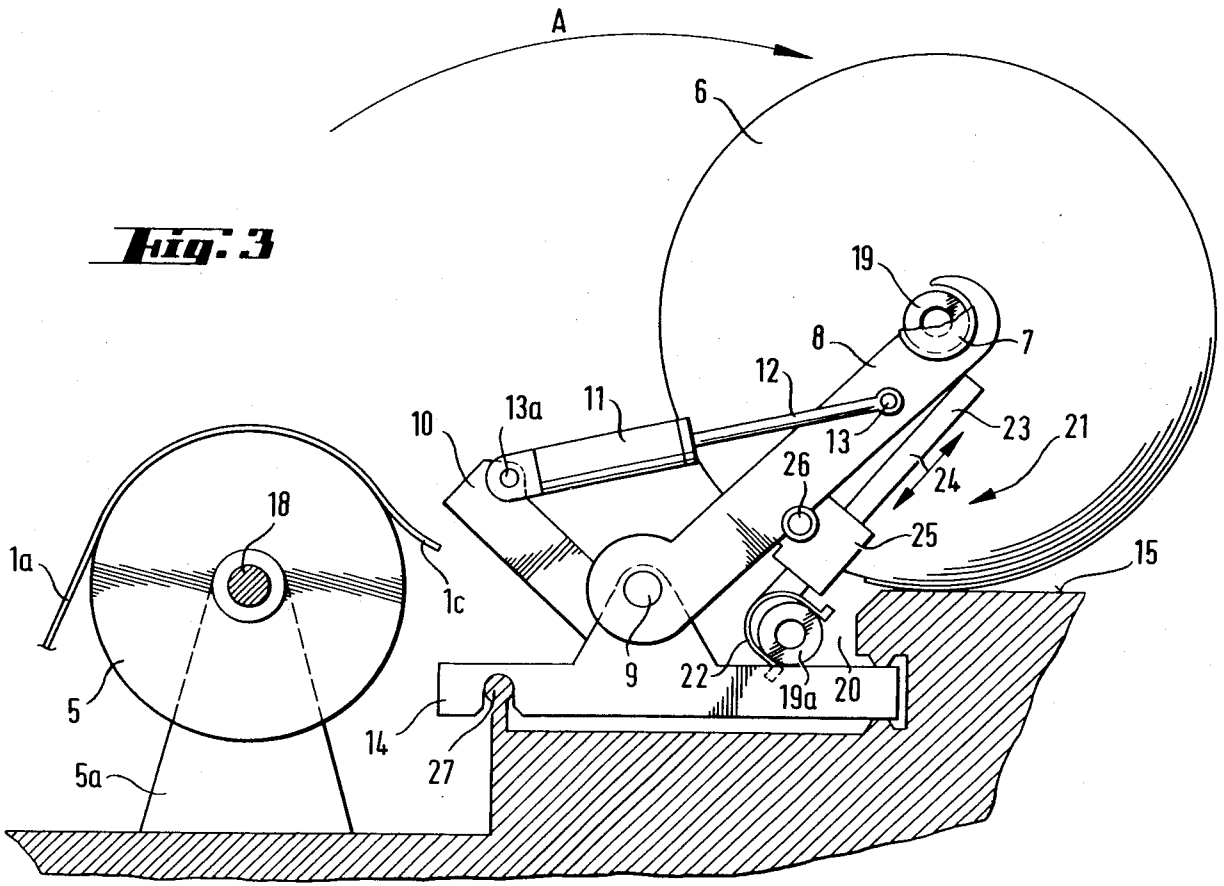
FIG. 3 shows the arrangement of FIG. 2 in another stage of the operation.

FIG. 3 shows a stage after the severing of web strip 1*a*, whereby completed roll 6 is descended on floor level 15 (arrow A). At this stage, support drum 5 is set to a slow crawling speed. A depression 20 is arranged below level 15 for lowering core 19*a* locked in the troughs 22, that roll 6 can be moved to floor level 15 over core 19*a* without touching it. Motion 24 of supply arm 23 is so adjusted, that core 19*a* and troughs 22 settle down in depresion 20 without touching the floor. Reference numeral 1*c* refers to a new leading end formed in the severing of web 1*a*. A guide 27 is located on the floor for the guidance of sledge 14. During the turning of support arm 8 in direction A, power arm 12 is first set to the full stroke value, after which the function of turning arm 10 is initiated.

Figure 4:
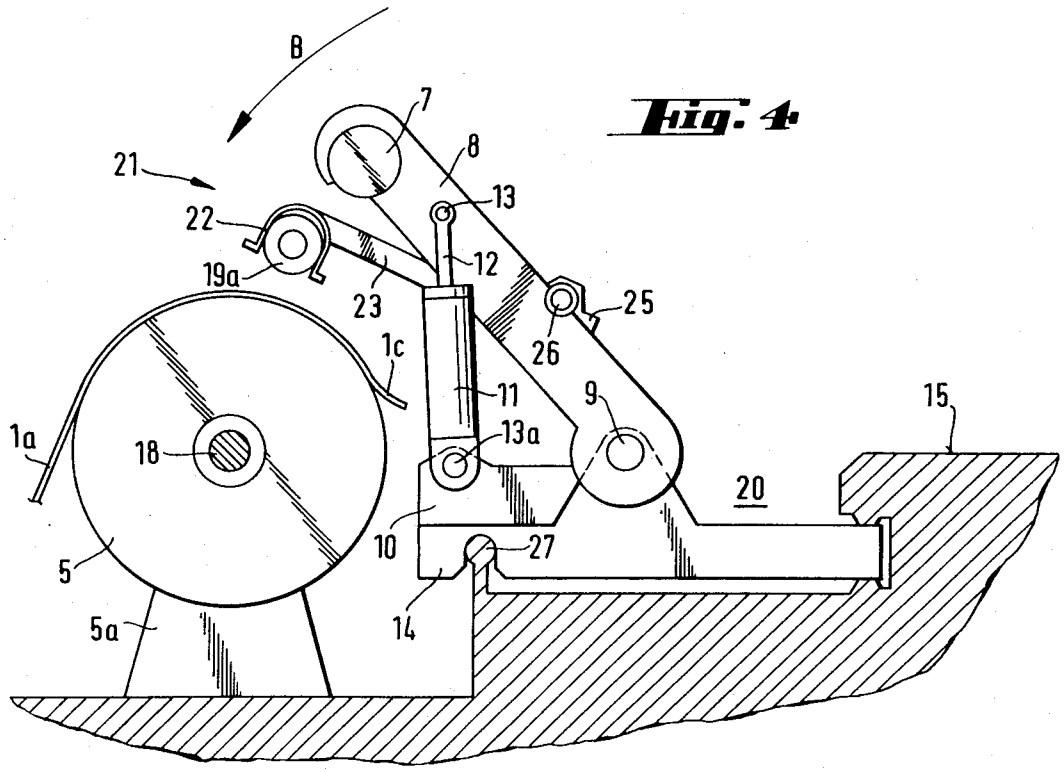
FIG. 4 shows the arrangement of FIGS. 2—3 in a third operation stage.

FIG. 4 discloses a supply stage of new core 19*a* slightly prior to the arrival of core 19*a* in the winding position. Supply arm 23 and support arm 8 are rotated in this embodiment around their turning centers 26 and 9 mainly during the same time. The turning of supply arm 23 in a direction B is, however, independent from the turning of support arm 8, so that after roll 6 is removed, arm 23 can be turned before turning support arm 8. When turning support arm 8 in direction B, turning arm 10 is first returned to its basic location (FIG. 2), after which power arm 12 is pulled to its minimum extension .

Core 19*a* being pressed against web 1*a* in the winding position by supply unit 22–26, stems 7 are arranged coaxially with core 19*a*. Thereafter stems 7 are moved in the axial direction in a holding grip on core 19*a* and supply troughs 22 are released from the grip on the core. By the motion track of core 19*a* is meant the transfer path of core 19*a* from depression 20 to the winding position. By means of motion 24, the distance of a track point of the motion track can be altered relative to the movable track center, which is located at bearing 26. The distance of the track point is so adjusted, that trough 22 does not hit the floor. During the B-directed main turning the distance can be adjusted to its maximum value, so that trough 22 is located at the maximum distance from bearing 26. Core supply appliance 21 shown in FIGS. 2–4 is located at that side of support arm 8, which faces the descending track for roll 6. Appliance 21 can equally be rotatably journalled at the central portion of arm 8, on that side of arm 8 facing roll 6. Appliance 21 is thereby so adjusted, that it easily settles within the free space between stem 7 and bearing 9 or the bearing of arm 10.

The invention is not restricted to the embodiment disclosed but several modifications of the invention are possible within the scope of the attached claims.

ANOTHER EMBODIMENT OF THE INVENTION

Instead of the one-piece support arm 8 shown one can apply a two-portion support arm that is hinged at its central part, the turning motion for portions of which can be arranged, by means corresponding to the appliance 10–13, 13*a* relative to the hinge.

Instead of the function order previously disclosed, the grip of stem 7 on core 19*a* can be arranged prior to the touching of core 19*a* on web 1*a*, also. Thereby stem 7 is first brought at the location of core 19*a* (FIG. 4) and stem 7 is arranged to grip core 19*a*. Supply trough 22 is released from core 19*a*. Thereafter core 19*a* is moved to press web 1*a*. In this set of order, the grip between stem 7 and core 19*a* is a part of the core supply function. During the time interval between the severing of web 1*a* and the arrival of core 19*a* in the winding position, web 1*a* can be held against drum 5 by members known per se.

I claim:

1. A winder for forming rolls by winding a succession of lengths of web-form material on a succession of cores, comprising a support drum, means for releasably holding a core with a finished roll formed thereon in a winding position in which the roll engages the support drum and receives peripheral support therefrom, the holding means being actuable to move the finished roll along a predetermined roll discharge path from the winding position to a receiving position in which the roll is spaced from the support drum, and core supply means for receiving a new core at a core supply position in the space between the drum and the receiving position and, when the finished roll has reached the receiving position, transferring the new core from the core supply position to a starting position in which it is releasably held by the holding means and cooperates with the support drum to grip the new leading end of a new length of webform material.

2. A winder according to claim 1, wherein the holding means support a roll in the winding position at its center.

3. A winder according to claim 1, wherein the core supply means and the holding means cooperate to transfer the new core from the core supply means to the holding means before the new core reaches a position in which it cooperates with the support drum to drip the new leading end of a new length of web-form material.

4. A winder according to claim 1, wherein the core supply means and holding means cooperate to transfer the new core from the core supply means to the holding means when the new core is in a position in which it cooperates with the support drum to grip the new leading end of a new length of web-form material.

5. A winder according to claim 1, wherein the holding means comprise a core stem that is movable in the axial direction of the core for holding and releasing an end of the core.

6. A winder according to claim 1 comprising means for pivotally supporting the core supply means from the holding means.

7. A winder according to claim 6, wherein the holding means comprise a movable support arm, and the pivotal support means are carried by the support arm.

8. A winder according to claim 7, comprising foundation means from which the support drum is supported, and means for pivotally mounting the support arm from the foundation means.

9. A winder according to claim 1, wherein the holding means comprise first and second holding units for releasably holding a core at opposite respective ends thereof, and the core supply means comprise first and second core supply units for receiving opposite respective ends of a new core, said first holding unit and said first core supply unit being separate from the second holding unit and the second core supply unit.

10. A winder according to claim 9, wherein the first holding unit and the first core supply unit are spaced at an adjustable distance from the second holding unit and the second core supply unit.

11. A winder according to claim 1, wherein the holding means comprise a support arm and a core stem supported by the support arm for gripping a core, and the core supply means comprise a supply trough supported at the support member in such manner that a new core held in the chore supply trough can be positioned coaxially with the core stem before the new core is gripped by the stem.

12. A winder according to claim 1, wherein the core supply means are operable to release a new core received by the core supply means when the core is held by the holding means.

13. A winder according to claim 1, wherein the distance between the core supply position and said predetermined roll discharge path is such that a finished roll can be moved along said predetermined roll discharge path without contacting a new core in said core supply position.

14. A winder according to claim 1, comprising foundation means defining a floor level, and wherein the holding means are movably supported relative to a support point located at the floor level and the core supply means are actuable to move a new core along a predetermined roll supply path from the core supply position to the starting position.

15. A winder according to claim 14, wherein the core supply means comprise a supply arm and means for pivotally mounting the supply arm to the holding means, a new core being moved from the core supply position to the starting position by pivotal movement of the supply arm about the holding means.

16. A winder according to claim 15, wherein the distance of the center of pivotal movement of the supply arm from said predetermined roll supply path varies as a function of position along said roll supply path.

17. A winder according to claim 15, comprising a bearing member for supporting the supply arm from the holding means, said supply arm being movable longitudinally relative to the bearing member.

18. A winder according to claim 1, wherein the peripheral support provided by the support drum to the finished roll when in the winding position has a force component that is directed vertically upwards and a force component that is directed horizontally, the force component that is directed vertically upwards being substantially greater than the force component that is directed horizontally.

19. Winder apparatus for forming rolls from a running web by slitting the web longitudinally into a plurality of web strips and winding the web strips into a corresponding plurality of rolls, the winder apparatus comprising a plurality of winders for receiving the web strips respectively, and each winder comprising a support drum, means for releasably holding a core with a finished roll formed thereon in a winding position in which the roll engages the support drum and receives peripheral support therefrom, the holding means being actuable to move the finished roll along a predetermined roll discharge path from the winding position to a receiving position in which the roll is spaced from the support drum, and core supply means for receiving a new core at a core supply position in the space between the drum and the receiving position and, when the finished roll has reached the receiving position, transferring the new core from the core supply position to a starting position in which it is releasably held by the holding means and cooperates with the support drum to grip the leading end of a web strip.

20. Winder apparatus according to claim 19, wherein the holding means of each winder support a roll in the winding position of that winder at the center of the roll.

21. Winder apparatus according to claim 19, wherein a first winder and a second winder are positioned with the central axes of their support drums extending substantially parallel to one another and spaced apart from one another in a direction perpendicular to the central axes of the support drums of the first and second winders, and wherein the winder apparatus comprises an auxiliary web leading drum associated with the second winder, and means for leading a first web strip over the roll support drum of the first winder and a second web strip over both the auxiliary drum and the roll support drum of the second winder so that the first and second web strips are wound into respective rolls in the same rotation direction, the web contact angle between the first web strip and the roll support drum of the first winder being substantially equal to the sum of the web contact angles between the second web strip and the auxiliary drum and between the second web strip and the roll support drum of the second winder.

22. A winder apparatus according to claim 19, wherein the peripheral support provided by the support drum of each winder to the finished roll when in the winding position has a force component that is directed vertically upwards and a force component that is directed horizontally, the force component that is directed vertically upwards being substantially greater than the force component that is directed horizontally.

23. A method of forming rolls by winding a succession of lengths of web-form material on a succession of cores using a winder that comprises a support drum, means for releasably holding a core with a finished roll formed thereon in a winding position in which the roll engages the support drum and receives peripheral support therefrom, the holding means being actuable to move the finished roll along a predetermined roll discharge path from the winding position to a receiving position in which the roll is spaced from the support drum, and the winder also comprising core supply means for receiving a new core and supplying it to a starting position in which it is releasably held by the holding means and cooperates with the support drum to grip the new leading end of a new length of web-form material, the method comprising delivering the new core to the core supply means at a core supply position in the space between the drum and the receiving position and, when the finished roll has reached the receiving position, transferring the new core from the core supply position to the starting position.

24. A method according to claim 23, comprising releasing the new core from the core supply means when the new core is held by the holding means.

25. A method according to claim 23, wherein the new core is delivered to the core supply position during winding of said finished roll.

26. A method according to claim 23, wherein the new core is positioned beneath said predetermined roll discharge path during movement of the finished roll along said predetermined roll discharge path.

27. A method according to claim 26, wherein the predetermined roll discharge path is curved about a horizontal axis, and the new core is moved from the core supply position to a position at a lower level than said horizontal axis during movement of the finished roll along the predetermined roll discharge path.

28. A method according to claim 27, wherein the movement of the new core is accomplished by cooperation of the core supply means and the holding means during movement of the finished roll along the predetermined roll discharge path.

29. A method according to claim 23, wherein the peripheral support provided by the support drum to the finished roll when in the winding position has a force component that is directed vertically upwards and a force component that is directed horizontally, the force component that is directed vertically upwards being substantially greater than the force component that is directed horizontally.

* * * * *